US005427905A

United States Patent [19]

Freedman et al.

[11] Patent Number: 5,427,905

[45] Date of Patent: Jun. 27, 1995

[54] THERMALLY PROCESSABLE IMAGE-RECORDING MATERIAL INCLUDING REDUCTONE DEVELOPING AGENT

[75] Inventors: James R. Freedman, Newton Centre; Kent M. Young, Carlisle, both of Mass.

[73] Assignee: Polaroid Corporation, Cambridge, Mass.

[21] Appl. No.: 274,650

[22] Filed: Jul. 13, 1994

[51] Int. Cl.[6] ..... G03C 1/498

[52] U.S. Cl. ..... 430/619; 430/203; 430/405; 430/485

[58] Field of Search ..... 430/617, 619, 447, 480, 430/481, 485, 415, 405, 203

[56] References Cited

U.S. PATENT DOCUMENTS

| | | | |
|---|---|---|---|
| 2,691,589 | 10/1954 | Henn et al. | 95/88 |
| 3,615,440 | 10/1971 | Bloom et al. | 96/29 |
| 3,664,835 | 5/1972 | Youngquist | 96/3 |
| 3,672,896 | 6/1972 | Gabrielsen et al. | 96/66 |
| 3,690,872 | 9/1972 | Gabrielsen et al. | 96/66 |
| 3,751,255 | 8/1973 | Wilson et al. | 96/66 |
| 3,816,137 | 6/1974 | Gabrielsen et al. | 96/76 |
| 4,195,038 | 3/1980 | Chiang | 260/586 |
| 4,260,677 | 4/1981 | Winslow et al. | 430/618 |
| 4,351,896 | 9/1982 | Altland et al. | 430/354 |
| 4,371,603 | 1/1983 | Bartels-Keith et al. | 430/218 |
| 4,433,037 | 2/1984 | DoMinh | 430/19 |
| 4,550,071 | 10/1985 | Aono et al. | 430/203 |
| 4,639,407 | 1/1987 | Aono et al. | 430/203 |
| 5,041,353 | 8/1991 | Takeda | 430/619 |
| 5,258,279 | 11/1993 | Simon et al. | 430/559 |

FOREIGN PATENT DOCUMENTS 59-180548 10/1984 Japan .

*Primary Examiner*—Thorl Chea
*Attorney, Agent, or Firm*—Edward W. Black

[57] ABSTRACT

There are disclosed thermally processable, image-recording materials including both thermographic and photothermographic materials. The image-recording materials disclosed herein include silver halide and a specified class of reductone developing agents, and are capable of being thermally processed in the absence of water and/or base.

13 Claims, No Drawings

THERMALLY PROCESSABLE IMAGE-RECORDING MATERIAL INCLUDING REDUCTONE DEVELOPING AGENT

BACKGROUND OF THE INVENTION

1. Field of the Invention

The present invention generally relates to thermally processable, image-recording materials including silver halide. More particularly, the present invention is directed toward such materials which are capable of being thermally processed in the absence of water and/or base and which include a specified class of reductone developing agents.

2. Description of the Related Art

Thermally processable image-recording materials, including both thermographic (imaged and developed thermally) and photothermographic materials (imaged with light and developed thermally), are well known in the art. Such materials often include silver halide therein for forming images. In photothermographic systems, the silver halide is light sensitive, whereas in thermographic systems, the silver halide is typically light-insensitive (e.g. the silver halide may be de-sensitized with dyes as known in the art or may be processed under non-exposing lighting conditions, i.e. wavelengths of light which the silver halide is not sensitive to).

Thermographic materials typically comprise a polymeric support coated with a source of silver e.g. silver halide and/or a silver salt e.g. silver behenate, a binder, and a developing agent. Images are recorded and processed thermally; that is, images are formed by imagewise heating of the media which results in an imagewise reduction of silver, thus forming an image in metallic silver.

Photothermographic materials typically comprise a polymeric support coated with a light-sensitive silver halide emulsion and a developing agent. Images are recorded by exposing the light-sensitive silver halide to light, thereby forming a latent image. This latent image is subsequently reduced to a final image by the application of heat in the presence of the developing agent.

Photothermographic materials can be generally divided into two classes. The first class of materials utilize silver halide as the sole source of silver. That is, silver halide not only functions as light-sensitive material for forming a latent image, but also serves as the sole source of silver for forming a final image, e.g. the light-sensitive silver may be developed to form a final negative image in reduced silver (metallic silver). Materials of this sort typically include a polymeric support including in one or several layers: (a) a silver halide emulsion, (b) a developing agent for converting the exposed silver halide to metallic silver, (c) an alkaline activator to obtain a pH at which the silver halide can be effectively developed, and (d) a stabilizer to tie up any undeveloped silver halide. Similarly, silver diffusion transfer systems are known wherein unexposed silver halide is dissolved and transferred to a separate layer where it is subsequently reduced to form a positive final image in reduced silver, or reacts with a color-providing material to form a colored image.

The second class of photothermographic materials utilize light-sensitive silver halide for forming a latent image upon exposure, but unlike the first class of materials just described, this second class of materials also utilizes a non-light sensitive source of silver, i.e. a silver salt such as silver behenate, for forming a final image. With such materials, exposed silver halide, upon heating, catalyzes an oxidation-reduction reaction between the non-light sensitive silver salt and a developing agent to form a final image. Examples of such materials are disclosed in U.S. Pat. Nos. 3,751,255; 4,639,407 and 4,260,677 wherein images in reduced silver are formed by imagewise reduction of silver ions provided by a light insensitive silver salt.

Examples of color photothermographic system are disclosed in U.S. Ser. Nos. 923,843; 079,146; and 058,494; all assigned to the assignee of the subject invention. These references disclose thermally processed systems wherein a light insensitive silver salt is utilized as a source of silver ions made available imagewise, upon heating, to cleave a dye-providing material, thus releasing a diffusible dye species which forms a colored image.

For a more detailed explanation of thermographic and photothermographic materials, reference should be made to: D. H. Klosterboer in J. Sturge, V. Walworth, and A. Shepp, eds., *Imaging Processes and Materials, Neblette's Eighth Edition*, Van Nostrand Reinhold, New York, 1989, pp. 279–291.

As just described, thermographic and photothermographic materials utilize developing agents for reducing silver to form a final image. Often times conventional photographic developers will work in thermally processable systems; however, this is not always the case. The specific nature of the thermally processable material will dictate the operability of the developer. For example, if the thermally processable material includes base or base precursors, traditional photographic developing agents such as hydroquinones may often be utilized. However, if the pH of the system is insufficient to ionize substantial quantities of the hydroquinone, hydroquinone developing agents will not develop sufficient silver to be operable in the system.

Reductone developer agents are yet another class of developing agents commonly used in photographic systems, e.g. see U.S. Pat. Nos. 2,691,589; 3,615,440; 3,664,835; 3,672,896; 3,690,872; 3,816,137; and 4,371,603. Photothermographic materials may also include reductone developing agents, e.g. see U.S. Pat. Nos. 4,433,037; 4,550,071; and 4,639,407. Although generally operable in photographic systems, reductone developer agents are often times inoperable in thermally processed systems, particularly those systems which are "dry" and base-free, i.e. those thermographic or photothermographic systems which are substantially free of water and base and which are thermally processed in the absence of water or base, as described in detail hereinbelow.

SUMMARY OF THE INVENTION

A thermally processable image-recording material comprising a support carrying in one or more layers: silver halide; a binder; and a developing agent represented by the formula:

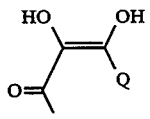

wherein (a) A and Q together represent carbon atoms necessary to complete a 4-, 5-, 6-, or 7-membered alicyclic ring structure consisting of less than 10 total carbon atoms; or (b) A and Q, the same or different, each independently represent a group selected from: hydrogen; alkyl having from 1 to 6 total carbon atoms; alicyclic having less than 7 total carbon atoms; alkaryl wherein the alkyl portion comprises from 1–3 total carbon atoms and the aryl portion comprises a 4, 5, or 6 membered aromatic ring structure having less than 9 total carbon atoms; and a 4-, 5-, or 6-membered aromatic ring structure having less than 9 total carbon atoms; wherein the image-recording material is substantially free of water and base and thermally processable in the absence of water and base.

It has been found that a specified class of reductones are unexpectedly superior developing agents for silver halide in thermally processable systems which are processed in the absence of base or water. An advantage of the present invention is that, through the use of the subject reductone developing agents, development of the present image-recording materials does not require the use of water or base, and as such, processing of the subject materials is simplified and less costly. Furthermore, by eliminating the need of base for development, the storage stability of the present materials is improved.

A further advantage of several embodiments of the present invention is that silver halide is the only source of silver required, thus, the system is simplified and less costly along with being more stable.

DETAILED DESCRIPTION OF THE INVENTION

The present invention is directed toward thermally processable, image-recording materials, including both thermographic (imaged and developed thermally) and photothermographic (imaged with light and developed thermally) materials. The present thermally processable materials comprise a support carrying in one or more layers; a silver halide, a binder, a developing agent, and may optionally include additional components such as silver salts and thermal solvents as described hereinbelow. These individual components may be coated upon the support as a single layer or in a variety of arrangements as will also be described hereinbelow.

The image-recording materials of the present invention are substantially free of water and base. The term "substantially free of water and base" is intended to indicate that neither water nor base is added to or incorporated in the image-recording material. However, it should be understood that water may be used as a solvent or dispersant in the preparation and coating of various components of the image-recording material, so long as any such water is subsequently substantially removed from the system, e.g. by drying. Although water is not directly added to the present materials, such materials may be in a state of equilibrium with moisture in the air. Such a state is described in T. H. James (ed.), *The Theory of the Photographic Process,* 4th Ed., Macmillan, New York 1977, pp. 374. Additionally, neither water nor base is necessary for processing (i.e. development of silver and formation of a final image) the present image-recording materials.

The term "base" in the context of the present invention is defined as a material that is added for the purpose of, or which causes, substantial deprotonation of a component of the thermally processable system, particularly image dyes or developers. Substantial deprotonation is defined for purposes herein as sufficient deprotonation to cause an impact on system performance i.e. to have a substantive effect. Examples of such materials include organic and inorganic salts of hydroxide, such as alkali metal hydroxides, ammonium hydroxides, and the like, and highly basic organic materials such as guanidine and the like.

The developing agents applicable to the present invention are a class of reductones represented by the formula:

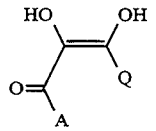

Formula 1 wherein A and Q may be taken together to form a common alicyclic ring structure, or may be taken independently. When taken together, A and Q represent carbon atoms necessary to complete a 4-, 5-, 6-, or 7-membered alicyclic ring structure wherein the ring structure, including any substituents, consists of less than 10 total carbon atoms. Said another way, although the alicyclic ring structures may be either unsubstituted or substituted, the total number of carbon atoms of the alicyclic ring structure, including any substituents, must be less than 10. By way of illustration, 2,3-dihydroxy-cyclohex-2-ene-1-one is an example of a reductone developing agent within the scope of the present invention (total carbon atoms of alicyclic ring structure is 6); whereas 2,3-dihydroxy-4,4,6,6-tetramethyl-cyclohex-2-ene-1-one is not within the scope of the present invention as it includes a 6-membered carbocyclic ring structure with four methyl substituents, i.e. an allcyclic ring structure having 10 carbon atoms. Preferably, when A and Q represent carbon atoms to complete an alicyclic ring structure, the ring structure consists of a 5- or 6-membered carbocyclic ring.

As indicated, the alicyclic ring structure may be substituted or unsubstituted. Suitable substituents are those which do not significantly lower the reduction potential of the developing agent so as to significantly lower the amount of silver developed within the system, e.g. halogen, hydroxyl, thioethers (-alkyl-S-alkyl), alkoxy and alkyl groups.

When taken independently, A and Q, the same or different, each represent a group selected from: hydrogen; alkyl having less than 7 total carbon atoms including any substituents; alicyclic having less than 7 total carbon atoms including any substituents; alkaryl wherein the alkyl portion comprises from 1–3 total carbon atoms including any substituents and the aryl portion comprises a 4-, 5-, or 6-membered aromatic ring structure having less than 9 carbon atoms including any substituents (however, excluding the alkyl group just described); and a 4-, 5-, or 6-membered aromatic ring structure having less than 9 total carbon atoms including any substituents. When A and Q are taken independently, preferably each represents a 6-membered aromatic ring, e.g. phenyl, pyridyl, etc. It should be understood that the aforementioned alkyl, alicyclic, alkaryl, and aromatic ring structure groups may be unsubstituted, or substituted with substituents which do not significantly lower the reduction potential of the developing agent so as to substantially lower the amount of silver developed within the system, e.g. halogen, hydroxyl, thioethers (-alkyl-S-alkyl), alkoxy and alkyl groups. However, the total number of carbon atoms, including any attributed to substituents, must not exceed the definitions provided above. Examples of suitable alkyl groups include methyl, ethyl, isopropyl, methoxymethyl. Examples of suitable alkaryl groups include benzyl, methyl pyridyl, ethyl pyridyl, methyl thienyl, ethyl thienyl, etc. Examples of suitable aromatic groups include pyridyl, thienyl, phenyl, and furyl.

Specific examples of reductone developing agents within the scope of the present invention include:

1,3-di-p-tolyl-2,3-dihydroxy-2-propene-1-one;
1,3-dipyridyl-2,3-dihydroxy-2-propene-1-one;
1-phenyl-3-pyridyl-2,3-dihydroxy-2-propene-1-one;
1,3-dithienyl-2,3-dihydroxy-2-propene-1-one;
1-phenyl-3-furyl-2,3-dihydroxy-2-propene-1-one;
1-(3,5-dimethylphenyl)-2,3-dihydroxy-2-propene-1-one;
1,3-dibenzyl-2,3-dihydroxy-2-propene-1-one;
1,3-dibutyl-2,3-dihydroxy-2-propene-1-one;
1-propyl-3-cyclohexyl-2,3-dihydroxy-2-propene-1-one;
1-propyl-3-(o-methoxyphenyl)-2,3-dihydroxy-2-propene-1-one;
1-(p-chloropyridyl)-3-(2-methoxyethyl)-2,3-dihydroxY-2-propene-1-one;
b 4,5-dimethyl reductic acid;
4,4-dimethyl reductic acid;
4-methoxy-reductic acid;
4,5-diethyl reductic acid;
4,5-di (chloromethyl) reductic acid;
4-propyl reductic acid;
4,6-dimethyl-2,3-dihydroxy-cyclohex-2-ene-1-one;
5,5-dimethyl-2,3-dihydroxy-cyclohex-2-ene-1-one;
5-bromo-2,3-dihydroxy-cyclohex-2-end-1-one;
5 -bromo-4,6-dimethyl-2,3-dihydroxy-cyclohex-2-ene-1-one;
5-ethyl-2,3-dihydroxy-cyclohex-2-ene-1-one;
5,5-dimethoxy-2,3-dihydroxy-cyclohex-2-ene-1-one;
5-thioethyl-2,3-dihydroxy-cyclohex-2-ene-1-one;
2,3-dihydroxy-cyclohept-2-ene-1-one;
5-methyl-2,3-dihydroxy-cyclohept-2-ene-1-one;
5-methyl-2,3-dihydroxy-cyclohept-2-ene-1-one;
2,3-dihydroxy-cyclobut-2-ene-1-one;
4-butyl-2,3-dihydroxy-cyclobut-2-ene-1-one; and
4,4-dimethyl-2,3-dihydroxy-cyclobut-2-ene-1-one.

Those skilled in the art will appreciate that the selection of a specific reductone developing agent for use in a particular thermally processable system will depend upon the other components of the system. For example, the reductone developing agent must be soluble within the system during thermal processing. Thus, the developing agent must be compatible with the "meltable" components (e.g. binder, thermal solvent, etc,) of the system during thermal processing. Furthermore, the developing agent must melt or dissolve within the "meltable" components during thermal processing. With such concerns in mind, the present reductone developing agents can be used alone or in combination with one another.

Additional considerations for the selection of the developing agent include the temperatures at which the materials are processed. The developing agent should not substantially volatilize, i.e. evaporate, during thermal processing. Furthermore, the developing agent should be selected to minimize any post-thermal processing effects such as undesirable odor and/or undesirable sensitometric effects, e.g. staining, fog, etc.

The reductone developing agents of the present invention may be prepared by techniques known in the art. The following references provide the general methodology for preparing the reductone developing agents of the present invention: Francis and Wilson. *J. Am. Chem Soc.,* (1913), pp. 2238; Hesse and Wehiling. Annalen 679 (1964), pp. 100; Hesse. Annalen 747 (1971), pp. 84; Hesse. Annalen 592 (1955), pp. 137, 145; Weygand, Simon, Bitterlich, Hodge, Fisher. *Tetrahedron* 6 (1959), p. 123; Witiak and Tehim. *J. Org. Chem.,* 55 (1990), pp. 1112–1114; Dahn and Hauth. *Helvetica Chim. Acta.* 54 (1954), pp. 1318–1327; Eistert et al. *Chem. Ber.* 93 (1960), p. 1451; Weber and Bauer. Annalen 763 (1972), p. 66; and Cavill and Solomon. *J. Chem. Soc.* (London) (1955), p. 4426.

The silver halide of the present invention may be any thermally processable (i.e. developable) silver halide employed in the photographic, photothermographic, or thermographic art, such as silver chloride, iodide, bromide, iodobromide, chlorobromide, etc., and may be prepared in situ or ex situ by any known method. The silver halide is typically prepared as part of an emulsion as is known in the art and may be spectrally sensitized or de-sensitized by any known method in order to extend or change the photographic sensitivity to wavelengths other than those absorbed by the silver halide. Examples of suitable sensitizers include cyanine dyes, merocyanine dyes, styryl dyes, hemocyanin dyes, and oxonole dyes. In addition to spectral sensitization, the silver halide emulsion may be chemically sensitized using any method known in the photographic art.

The image-recording materials of the present invention further include binders. Suitable binders include water soluble synthetic high-molecular weight compounds such as polyvinyl alcohol and polyvinylpyrrolidone and, synthetic or natural high-molecular weight compounds such as gelatin, gelatin derivatives, cellulose derivatives, proteins, starches and gum arabic. A single binder or mixture of binders may be used. Gelatin is the preferred binder for use in the subject image-recording material, as will be described. Portions of the subject photothermographic system which contain a crosslinkable colloid as a binder, e.g., gelatin, can be hardened by using various organic and inorganic hardeners such as those described in T. H. James, *The Theory of the Photographic Process,* 4th Ed., MacMillan, New York, 1977, pp. 77–87. The hardeners can be used alone or in combination. Any suitable hardener known in the photographic art may be used, however, aldehyde hardeners, e.g., succinaldehyde and glyoxal, have been found to be particularly useful when gelatin is employed as the binder.

The image-recording materials of the present invention preferably include thermal solvents. Thermal solvents are non-hydrolyzable compounds which are solids at ambient temperature but which melt at or below the temperature used for processing. The temperature at which the thermal solvent melts in the heat-sensitive system will generally be lower than the melting point of the thermal solvent itself and represents a mixed melting point resulting from the combination of the thermal solvent with one or more other components in the heat-sensitive system. The thermal solvent acts as a solvent for various components of the subject materials, it helps to accelerate thermal development and it provides the medium for diffusion of various materials including silver ions and/or silver complexes, developing agents, etc. With the present image-recording materials, the reductone developing agents may serve as a thermal solvent. Two or more thermal solvents may be used in combination. Illustrative thermal solvents useful in the present invention include polar organic compounds such as the polyglycols described in U.S. Pat. No. 3,347,675 and the compounds described in U.S. Pat. No. 3,667,959. Particularly useful compounds include urea derivatives, e.g., dimethylurea, diethylurea and phenylurea; polyhydric alcohols, e.g., 1,2-cyclohexanediol and pentaerythritol; amide derivatives such as acetamide; sulfonamide derivatives e.g. benzenesulfonamide and α-toluenesulfonamide, and benzamide derivatives e.g. 3,4-dimethylbenzamide, m-toluamide and TS-1 represented by the formula:

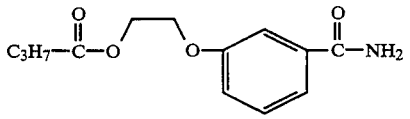

TS-1

The support used in the present invention must necessarily be able to withstand the heat required for processing the image, and any suitable support can be employed such as those described in Research Disclosure No. 17029, issued June 1978. Specific examples of suitable supports include synthetic plastic films, such as a polyester film, a polyvinyl chloride film or a polyimide film and paper supports, such as, photographic raw paper, printing paper, baryta paper and resin-coated paper. Preferably, a polyester film is used. A subcoat may be added to the face of the support which carries the heat-developable photosensitive materials in order to increase adhesion. For example, a polyester base coated with a gelatin subcoat has been found to enhance adhesion of aqueous based layers.

Additionally, the image-recording materials of the present invention may include other materials heretofore suggested in the art but are not essential. These include, but are not limited to, anti-foggants, antistatic materials, coating aids e.g., surfactants, activators and the like. A protective layer may also be present. The protective layer may contain a variety of additives commonly employed in the photographic art. Suitable additives include matting agents, colloidal silica, slip agents, organofluoro compounds, UV absorbers, accelerators, antioxidants, etc.

EXAMPLES

To better illustrate the present invention, examples of thermally processable image-recording materials were prepared and tested as described hereinbelow. For each Example material, several samples were prepared and tested as both thermographic and photothermographic image-recording materials. In general, thermographic testing consisted of comparing the percentage of silver developed in samples which were thermally processed at 120° C. for 30 seconds with identical samples which were unprocessed. Since all the Examples included light-sensitive silver halide, thermographic testing was conducted by preparing and thermally processing samples under non-exposing lighting conditions, i.e. utilizing red light to avoid any exposure or related photolytic effects with the silver halide. Those skilled in the art will appreciate that other techniques for using silver halide within thermographic image-recording systems may be used, e.g. pre-fogging (pre-exposing) the silver halide prior to thermal processing and/or de-sensitizing the silver halide with chemical de-sensitizing dyes, as is well known in the art.

Photothermographic tested generally consisted of comparing the percentage of silver developed in samples which were exposed to white light and thermally processed at 120° C. for various time periods with substantially identical samples which were unexposed but also thermally processed.

Seventeen Examples were prepared and tested as will now be described. Examples 1–13 each included: a binder, hardener, thermal solvent, surfactant, developing agent and silver halide as the sole source of silver; Examples 13–17 additionally included a light insensitive silver salt.

The hardener, succinaldehyde, and surfactant, zonyl FSN (perfluoroalkyl polyethylene oxide non-ionic surfactant, available form DuPont Corporation), used in all the Examples were prepared and coated as aqueous solutions. The binder used in each Example was an inert, deionized, derivatized bone gelatin, (available from Rousselot, France). The light-sensitive silver halide used in all the Examples was a silver iodobromide dispersion of a 0.25 μm cubic unsensitized iodobromide (2% iodide) emulsion prepared by standard techniques known in the art.

Examples 1–5

Of the Examples 1–5, only Examples 1 and 3 contained reductone developing agents, and only Example 1 contained a reductone developing agent within the scope of the present invention.

The thermal solvent dispersions used for Examples 1–5 were prepared by dispersing 8 g of m-toluamide (available from the Aldrich Chemical Co.) in a mixture of 3.5 g of 11.39% aqueous solution of Daxad 11 kls (potassium salt of a polyalkylnapththalene sulfonic acid), 2 g of 18.14% solution of gelatin and 30.25 g of deionized water. The resulting mixture was ground at approximately 15° C. at 300 r.p.m. with 180 g of zirconia beads for approximately 18 hours. 5 g of deionized water was added to the mixture during isolation to yield a 15.37% aqueous m-toluamide dispersion, determined by analysis.

Examples 1–5 each included a different developing agent, as indicated in Table 2 below. The developing agent solution for Example 1 was a 6% aqueous solution of tetramethyl reductic acid, pH adjusted to 7 with potassium hydroxide. The developing agent solution for Example 2 was a 21.4% solid dispersion prepared by adding 75.0 g of dimezone-S to 75.0 g of 5% aqueous Alkanol XC and 100.0 g of deionized water. The resulting mixture was ground with zirconia beads for approximately 5.5 hours. An additional 100.0 g of deionized water was added during isolation. The developing agent solution for Example 3 was a 9.1% aqueous solution of ascorbic acid, pH adjusted to 7 with potassium hydroxide. The developing agent solution for Example 4 was a 16.7% solid dispersion prepared by adding 2.0 g of hydroquinone to 0.88 g of a 11.39% aqueous solution of Daxad 11 kls (potassium salt of a polyalkylnapththalene sulfonic acid) and 7.12 g of deionized water. The mixture was ground with zirconia beads until the particle size was less than about 1 micron, (approximately 18 hours). An additional 2.0 g of deionized water was added during isolation. The developing agent for Example 5 was 4-aminomorpholine added as a neat liquid.

Examples 1–5 were prepared by coating the above-described components (silver halide, binder, hardener, thermal solvent, surfactant, and a developing agent) in a single layer upon a gelatin subcoated 4 mil polyester support (available from DuPont Corporation) with #36 Mayer Rod to yield the dry coating coverages provided in Table 1.

TABLE 1

| Component | Coverage |
|---|---|
| Binder (gelatin) | 3000 (mg/m$^2$) |
| Thermal Solvent (m-toluamide) | 3000 (mg/m$^2$) |
| Silver Halide (silver iodobromide) | 2 mmole/m$^2$ |
| Developing Agent (see Table 2) | 4 mmole/m$^2$ |
| Hardener (succinaldehyde) | 60 (mg/m$^2$) |
| Surfactant (zonyl FSN) | 0.1% by wt. |

The percentage of silver developed was determined for both thermographic and photothermographic samples of each Example and is reported in Table 2 below.

The thermographic samples of each Example material were maintained under non-exposing lighting conditions (red light) both during their preparation and testing. For each Example material, several samples were prepared of which included samples which were 1) thermally processed and fixed, 2) unprocessed and fixed, and 3) unprocessed and unfixed (control). The control sample permitted the total amount of silver coated for each Example to be determined. Thermally processing consisted of heating the samples at approximately 120° C. for 30 seconds against a second polyester sheet using a heated plate. The thermally processed coated negatives were subsequently peeled apart from their corresponding second polyester support sheets. Both the thermally processed coated negatives and unprocessed (unheated) samples of each Example were then fixed in red light by sequential washing in four baths as follows:

| | Component(s) | Time (minutes) |
|---|---|---|
| Bath 1: | Water | 5 |
| Bath 2: | Ammonium thiocyanate (100 g)<br>Methanol (500 ml)<br>Water (500 ml) | 23 |
| Bath 3: | Kodak Rapid Fixer ®<br>(acid hardening fixer) | 5 |
| Bath 4: | Water | 10 |

The percent of silver developed for both the thermally processed samples and the unprocessed samples of each Example is reported in Table 2 below. The unprocessed, unfixed control sample for each Example provided a means of determining the total amount of silver coated, from which the percentage of silver developed could be readily determined. More specifically, the percentage of silver developed for both the thermally processed and unprocessed thermographic samples of Examples 1–5 can be determined by equations 1 and 2, respectively.

Equation 1:

$$\frac{\text{Thermally Processed Ag Developed}}{\text{Total Ag Coated}} \times 100$$

Equation 2:

-continued $$\frac{\text{Unprocessed Ag Developed}}{\text{Total Silver Coated}} \times 100$$

Photothermographic samples were prepared for each Example and include samples which were 1) exposed to light, thermally processed and fixed, 2) unexposed, thermally processed and fixed, 3) unexposed, unprocessed and fixed (used to determine fog), and 4) a control sample which was unexposed, unprocessed and not fixed (used to determine the total quantity of silver coated. The exposed samples included three samples exposed to white light for $10^{-3}$ seconds. The exposed samples, along with some of the unexposed samples were then thermally processed at 120° C. for different time periods, i.e. 10, 20, and 30 second time intervals respectively, against a second polyester sheet using a heated plate. The thermally processed coated negatives were then peeled apart from their corresponding second polyester support sheets and fixed in red light as described above with respect the thermographic samples. The percent of silver developed for both thermally processed exposed and thermally processed unexposed samples is reported in Table 2. The percent of exposed silver developed reported is the amount of silver developed minus any fog (i.e. unexposed, unheated, developed silver) divided by the total amount of silver coated (determined by reference to the control sample which was unexposed, unprocessed and not fixed) measured after processing for 10, 20 and 30 second time periods. More specifically, the percentage of exposed silver developed at each time interval can be calculated by Equation 3 as provided below. Equation 3:

Equation 3:

$$\frac{\{\text{Thermally Processed, Exposed Ag Developed} - \text{Unprocessed Unexposed Ag Developed}\}}{\text{Total Ag Coated}} \times 100$$

Similarly, the percent of unexposed silver developed is the amount of unexposed silver developed minus any fog (i.e. unexposed, unprocessed, developed silver) divided by the total amount of silver coated measured after processing for 10, 20, and 30 second time periods. More specifically, the percentage of unexposed silver developed at each time interval can be calculated by Equation 4 as provided below.

Equation 4:

$$\frac{\{\text{Thermally Processed, Unexposed Ag Developed} - \text{Unprocessed Unexposed Ag Developed}\}}{\text{Total Ag Coated}} \times 100$$

For both the thermographic and photothermographic samples, the coatings were subsequently air-dried and the reduced silver coverage measured by x-ray fluorescence. The percent of silver developed is reported in Table 2 below.

TABLE 2

| Example | Developing Agent | THERMOGRAPHIC TESTING % Silver Developed (thermally processed/ unprocessed) Eq. 1/Eq. 2 | PHOTOTHERMOGRAPHIC TESTING % Silver Developed After Thermal Proc. (exposed/unexposed) Eq. 3/Eq. 4 10 sec | 20 sec | 30 sec |
|---|---|---|---|---|---|
| 1 | Tetramethyl reductic Acid | 41/2 | 18/2 | 31/4 | 41/5 |
| 2 | Dimezone-S | 10/1 | 8/2 | 7/1 | 10/1 |
| 3 | Ascorbic Acid | 1/1 | 2/2 | 1/1 | 1/1 |
| 4 | Hydroquinone | 1/1 | 1/1 | 1/1 | 1/1 |
| 5 | 4-Amino-morpholine | 1/1 | 1/1 | 1/1 | 1/1 |

The developing agents used in Examples 1–5 are all known photographic developing agents used in photographic systems wherein development takes place under "wet" and/or alkaline conditions.

As illustrated by Table 2, many developing agents commonly used in photographic systems do not exhibit similar silver halide developing characteristics in thermally processed systems which employ neither base nor water during development. More specifically, of the developing agents provided in Table 2, only the developing agent of the present invention, Example 1 (tetramethyl reductic acid), developed a significant amount of silver. Table 2 further indicates that not all reductones exhibit similar silver developing characteristics in thermally processed systems utilizing silver halide. More specifically, as between the Examples including reductone developing agents shown in Table 2, i.e. Examples 1 and 3, only the subject reductone, Example 1, developed a significant amount of silver.

Examples 6–13

Each of Examples 6–13 included one reductone developing agent; however, only Examples 6, 11 and 12 included reductone developing agents within the scope of the present invention.

The thermal solvent dispersions for Examples 6–13 were prepared by dispersing 15.7 g of 3,4-dimethylbenzamide (available from Ryan Scientific, Columbia, S.C.) in a mixture of 2.2 g of 10% aqueous polyvinylpyrrolidone (PVP K90), 2.7 g of 5% aqueous Alkanol XC (available form DuPont Corp.) and 39.4 g of deionized water. The resulting mixture was ground in a ball mill at approximately 15° C. at 300 r.p.m. with 180 g of zirconia beads for approximately 18 hours. 7.5 g of deionized water was added to the mixture twice during isolation to yield a 20.9% aqueous dispersion.

Eight different reductone developing agent solutions were prepared for Examples 6–13 and are listed in Table 4 below. The reductone developing agents corresponding to Examples 6–12 were prepared as aqueous solution, pH adjusted to 7.3 with potassium hydroxide. Examples 6, 8, and 10–12 were prepared as 6.0% aqueous solutions, Example 7 was prepared as a 5.4% aqueous solution, and Example 9 was prepared as a 4.8% aqueous solution. The developing agent corresponding to Example 13 was prepared as a 7.5% solution in methanol.

Examples 6–13 were prepared by coating the above-described components (silver halide, binder, hardener, surfactant, thermal solvent, and developing agent) in a single layer upon a gelatin subcoated 4 mil polyester support (available from DuPont Corporation) with #36 Mayer Rod to yield the dry coating coverages provided in Table 3.

TABLE 3

| Component | Coverage |
|---|---|
| Binder (gelatin) | 3000 (mg/m$^2$) |
| Thermal Solvent (3,4-dimethylbenzamide) | 3000 (mg/m$^2$) |
| Silver Halide (silver iodobromide) | 2 mmole/m$^2$ |
| Developing Agent (see Table 4) | see Table 4 |
| Hardener (succinaldehyde) | 60 (mg/m$^2$) |
| Surfactant (zonyl FSN) | 0.1% by wt. |

Examples 6–13 each included a different reductone developing agent coated in a coverage as indicated in Table 4, provided below.

TABLE 4

| Example | Developing Agent | Coverage (mg/m$^2$) |
|---|---|---|
| 6 | Tetramethyl reductic acid | 681 |
| 7 | 2,3-dihyroxy-4-phenyl-2-butene lactone | 897 |
| 8 | 3,4-dihyroxytricyclo [5.2.1.02,6]-dec-3,8-diene-5-one | 712 |
| 9 | Squaric Acid | 456 |
| 10 | 2,3-dihydroxy-4,4,6,6-tetramethylcyclohex-2-ene-1-one | 737 |
| 11 | 2,3-dihydroxycyclohex-2-ene-1-one | 512 |
| 12 | 1,3-diphenyl-2,3-dihydroxy-2-propene-1-one | 961 |
| 13 | 2-hydroxy-3-amino-4,4,6,6-tetramethylcyclohex-2-ene-1-one | 780 |

Thermographic and photothermographic samples for each of Examples 6–13 were tested as previously described with respect to Examples 1–5, the results of which are provided in Table 5 below.

As with Examples 1–5, in Examples 6–13 the percentage of silver developed for both the thermally processed and unprocessed thermographic samples can be determined by Equations 1 and 2, respectively. Similarly, the percentage of silver developed for both the exposed and unexposed photothermographic samples can be determined by Equations 3 and 4, respectively.

TABLE 5

| Example | Developing Agent | THERMOGRAPHIC TESTING % Silver Developed (thermally processed/ unprocessed) Eq. 1/Eq. 2 | PHOTOTHERMOGRAPHIC TESTING % Silver Developed After Thermal Proc. (exposed/unexposed) Eq. 3/Eq. 4 10 sec | 20 sec | 30 sec |
|---|---|---|---|---|---|
| 6 | Tetramethyl reductic acid | 32/12 | 4/−3 | 15/−3 | 20/−4 |
| 7 | 2,3-dihyroxy-4- | 15/9 | 2/−2 | 3/0 | 5/0 |

TABLE 5-continued

| Example | Developing Agent | THERMOGRAPHIC TESTING % Silver Developed (thermally processed/ unprocessed) Eq. 1/Eq. 2 | PHOTOTHERMOGRAPHIC TESTING % Silver Developed After Thermal Proc. (exposed/unexposed) Eq. 3/Eq. 4 | | |
|---|---|---|---|---|---|
| | | | 10 sec | 20 sec | 30 sec |
| | phenyl-2-butene lactone | | | | |
| 8 | 3,4-dihyroxytricyclo [5.2.1.02,6]-dec-3,8-diene-5-one | 7/12 | 0/−5 | 0/−5 | −5/−5 |
| 9 | Squaric Acid | 9/9 | −1/−1 | 1/−3 | 1/−3 |
| 10 | 2,3-dihydroxy-4,4,6,6-tetramethylcyclo hex-2-ene-1-one | 9/11 | 0/−1 | −1/−2 | −1/−2 |
| 11 | 2,3-dihydroxy cyclohex-2-ene-1-one | 39/12 | −5/−5 | 10/6 | 27/20 |
| 12 | 1,3-diphenyl-2,3-dihydroxy-2-propene-1-one | 32/10 | 1/0 | −1/0 | 22/13 |
| 13 | 2-hydroxy-3-amino-4,4,6,6-tetramethylcyclo hex-2-ene-1-one | 10/8 | 2/−2 | 0/−2 | 2/−2 |

With reference to Table 5, negative values for % silver developed resulted from scatter in the data whereby the difference between silver developed and fog is less than zero. In a practical sense, negative values indicate no development above fog.

As indicated in Table 5, Examples 6, 11, and 12 had significantly higher percentages of silver developed for both thermographic and photothermographic samples as compared to the remaining Examples 7–10, and 13. Based upon the percentages of silver developed, as provided in Table 5, it is clear that reductones, as a class, do not exhibit similar silver development properties in thermally processed systems utilizing silver halide and which employ neither water nor base. Indeed, of the reductones shown in Table 5, only those falling within the scope of the present invention showed significant silver reduction i.e. Examples 6, 11, and 12.

Other embodiments of the present invention include thermally processed materials having organic silver salts therein. Such silver salts should be relatively light stable and thermally stable under the processing conditions. The silver salt is generally an organic silver salt or silver salt complex as heretofore known in the art. Any organic compound known in the photographic art to be useful for forming the organic silver salt may be employed, see, e.g., those described in U.S. Pat. No. 4,729,942. See U.S. Pat. No. 4,260,677 for useful silver salt complexes. However, for the purposes of this discussion, the silver salt is not a silver halide. Examples of suitable silver salts include silver salts of carboxylic acids, e.g., behenic and stearic acids and silver salts of compounds having an imino group. The silver salts of benzotriazole and its derivatives are further examples of suitable silver salts. The silver salts used in the present invention can be prepared in a suitable binder by any known means and then used immediately without being isolated. Alternatively, the silver salt may be isolated and then dispersed in a suitable binder.

Examples 14–17

Examples 14–17 each included a reductone developing agent therein; however, only Example 14 included a reductone developing agent within the scope of the present invention.

As a further illustration of the subject invention, Example materials 14–17 were prepared each including a silver salt therein. The light-sensitive silver halide, binder, hardener, and surfactant were prepared in a manner substantially similar to that previously described with respect to Examples 1–13.

The silver salt dispersions for Examples 13–17 were prepared by adding 415 g of benzotriazole to 325 mL of concentrated ammonium hydroxide. 450 g of gelatin was added to the resulting solution which was diluted to a total volume of 6 liters with water. The mixture was placed in the dark at 40° C. and a mixture prepared by combining 550 g of silver nitrate with 500 mL of concentrated ammonium hydroxide and diluted to a total volume of 2.1 liters with water was added to the benzyltriazole with stirring, over a one-hour period. The resulting mixture stood at room temperature for about 60 minutes at which time, the material was washed using standard emulsion washing procedures. The pH of the material was adjusted to 6 and the pAg adjusted to 7.4.

The thermal solvent dispersion for Examples 14–17 was prepared by dispersing 64 g of the thermal solvent designated TS-1, in a mixture of 8.8 g of 10% aqueous polyvinylpyrrolidone (PVP K90), 10.8 g of 5% aqueous Alkanol XC (available from DuPont, Wilmington, Del.) and 160.4 g of water. The resulting mixture was ground in a ball mill for 7 hours. 100 g of deionized water was introduced for washing purposes during the isolation of the dispersion.

The following four reductone developing agent solutions were prepared for Examples 14–17 and are indicated in Table 7 below:

(i) a 6.0% aqueous solution of tetramethyl reductic acid, pH adjusted to 7 with potassium hydroxide;

(ii) a 12.4% 2-hydroxy-3-amino-4,4,6,6-tetramethylcyclohex-2-ene-1-one solution in methanol;

(iii) a 10.1% 2-hydroxy-3-amino-5,5-dimethylcyclopent-2-ene-1-one solution in methanol; and (iv) a 3.4% aqueous solution of 2-hydroxy-3-(N-morpholino)-5-hydroxy-5-methyl-cyclopent-2-ene-1-one.

Examples 14–17 were each prepared by coating the above-described components (silver halide, silver salt, binder, hardener, thermal solvent, surfactant, and developing agent) in a single layer upon a gelatin subcoated 4 mil polyester support (available from DuPont Corporation) with #30 Mayer Rod to yield the dry coating 20 coverages provided in Table 6.

TABLE 6

| Component | Coverage |
|---|---|
| Binder (gelatin) | 3000 (mg/m$^2$) |
| Thermal Solvent (TS-1) | 3000 (mg/m$^2$) |
| Silver Halide (silver iodobromide) | 2 mmole/m$^2$ |
| Silver Salt (silver benzotriazole) | 2 mmole/m$^2$ |
| Developing Agent (see Table 7) | 4 mmole/m$^2$ |
| Hardener (succinaldehyde) | 100 (mg/m$^2$) |
| Surfactant (zonyl FSN) | 0.1% by wt. |

Examples 14–17 were tested as described above with reference to Examples 1–13 except that the photothermographic samples were thermally processed for 30 seconds. The results of the testing are provided in Table below.

As with Examples 1–13, in Examples 14–17 the percentage of silver developed for both the thermally processed and unprocessed thermographic samples can be determined by Equations 1 and 2, respectively. Similarly, the percentage of silver developed for both the exposed and unexposed photothermographic samples can be determined by Equations 3 and 4, respectively.

TABLE 7

| Example | Developing Agent | THERMOGRAPHIC TESTING % Silver Develop. (thermally processed/unprocessed) Eq. 1/Eq. 2 | PHOTOTHERMOGRAPHIC TESTING % Silver Developed After 30 Seconds Thermal Processing (exposed/unexposed) Eq. 3/Eq. 4 |
|---|---|---|---|
| 14 | Tetramethyl reductic Acid | 64/4 | 60/0 |
| 15 | 2-hydroxy-3-amino-4,4,6,6-tetramethylcyclo hex-2-ene-1-one | 6/1 | 0/0 |
| 16 | 2-hydroxyl-3-amino-5,5-dimethylcyclo pent-2-ene-1-one | 1/1 | 5/0 |
| 17 | 2-hydroxy-3-(N-morpholino)-5-hydroxy-5-methyl-cyclopent-2-ene-1-one | 0/0 | 0/0 |

As illustrated by Table 7, reductones, as a class, do not equivalently develop silver in thermally processed systems which are processed without water or base. Indeed, of the reductones used in Examples 14–17, only Example 14 (tetramethyl reductic acid) developed a significant amount of silver.

Although Examples 1–17 were directed toward forming a final image in reduced silver, i.e. black and white images, the subject invention further includes color image-recording materials. Color image-recording materials include color-providing materials, such as dyes or dye precursors, which are transferred to an image receiving layer as a function of imagewise heating or exposure. Numerous mechanisms for controlling dye transfer are known in the art. For example, the color-providing materials include those which are normally diffusible and are rendered non-diffusible upon reaction with silver ions and/or a soluble silver complex, and non-diffusible color-providing materials which are rendered diffusible upon reaction with silver ions and/or a soluble silver complex. In such systems, silver halide is developed with a developing agent in the presence of a silver halide solvent to develop an image and to form in terms of undeveloped silver halide, an imagewise distribution of a soluble silver complex-providing silver ions for reaction with the color-providing material. Upon reaction of the imagewise distribution of soluble silver ions with the color-providing material, an imagewise distribution of diffusible color-providing material is formed, thereby controlling transfer of color-providing material to form a color transfer image.

More specific examples of thermally processed color systems are disclosed in U.S. Pat. Nos. (Ser. Nos. 07/923,843, filed Jul. 31, 1992; 08/079,146, filed Jun. 17, 1993; and 08/058,494, filed May 6, 1993) assigned to the assignee of the present invention and are incorporated herein by reference. These references disclose systems wherein a light insensitive silver salt is utilized as a source of silver ions made available imagewise upon heating to cleave a dye-providing material, thus releasing a diffusible dye species which forms a colored image. With such image-recording materials, it is often desirable to separate various components into different layers. For example, it is often desirable to coat a dye-providing material in a separate layer from a silver salt or silver halide. As discussed in these references, various coating arrangements are possible. However, within the context of the present invention, it is preferred to coat the subject developing agents either with the light-sensitive silver halide, or in a layer immediately adjacent thereto.

Examples of other applicable color systems include those utilizing a positive-working, Ring Opening by Single Electron Transfer (ROSET) process for releasing a dye. With such systems, exposed silver halide is reduced. In areas of non-exposure, the developing agent initiates ring opening by cleavage of a singe N-O bond in the color-providing material resulting in subsequent dye release, as generally described in European Patent Application 0,220,746. Similar mechanism are shown in U.S. Pat. Nos. 4,619,884; 4,609,610; 4,450,223; and 4,343,893 and are applicable to the present invention.

Still further examples of systems applicable to the present invention are those utilizing leuco dyes which, when heated in the presence of a silver salt, such as silver behenate, and in the presence of a latent image, are oxidized to a colored dye.

Thermally processable image-recording systems utilizing dye bleaching imaging systems, e.g. wherein an azo dye, (as disclosed in U.S. Pat. No. 4,248,772) is bleached (rendered colorless) in the presence of developed silver and acid, are also applicable to the present invention.

The photosensitive elements of the present invention may be exposed by any of the methods used in the photographic art, e.g., a tungsten lamp, a mercury vapor lamp, a halogen lamp, fluorescent light, a xenon flash lamp or a light emitting diode including those which emit infrared radiation.

As previously stated, the image-recording material of the present invention is thermally processable. This is generally accomplished by heating the material at a temperature in the range of 80° to 200° C., preferably in the range of 100° to 150° C., for a period of from 1 to 720 seconds, preferably 1.5 to 360 seconds. Both heat and pressure may be applied simultaneously. All methods of heating that can be employed in heat-developable systems known in the art may be applied to the heat-developable material of the present invention. Thus, for example, heating may be accomplished by using a hot plate, an iron, heated rollers or a hot drum.

Many modifications and variations of the subject invention are possible in light of the above teachings. It is therefore, to be understood that within the scope of the appended claims, the invention may be practiced otherwise than as specifically described.

What is claimed:

1. A thermally processable image-recording material comprising a support carrying in one or more layers:

silver halide; a binder; and a developing agent represented by the formula:

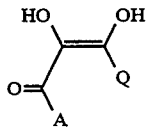

wherein (a) A and Q together represent carbon atoms necessary to complete a 4-, 5-, 6-, or 7-membered alicyclic ring structure consisting of less than 10 total carbon atoms; or (b) A and Q, the same or different, each independently represent a group selected from: hydrogen; alkyl having from 1 to 6 total carbon atoms; alicyclic having less than 7 total carbon atoms; alkaryl wherein said alkyl portion comprises from 1–3 total carbon atoms and said aryl portion comprises a 4-, 5-, or 6-membered aromatic ring structure having less than 9 total carbon atoms; and a 4-, 5-, or 6-membered aromatic ring structure having less than 9 total carbon atoms;

said image-recording material being substantially free of water and base and thermally processable in the absence of water and base.

2. The thermally processable image-recording material as set forth in claim 1 wherein:

(a) A and Q represent carbon atoms necessary to complete a 5- or 6-membered alicyclic ring structure; or (b) A and Q, the same or different, each represent 4-, 5-, or 6-membered aromatic ring structure.

3. The thermally processable image-recording material as set forth in claim 1 wherein A and Q, the same or different, each represent a 6-membered aromatic ring structure.

4. The thermally processable image-recording material as set forth in claim 1 wherein said developing agent is selected from the group consisting of:

(a) tetramethylreductic acid;

(b) 2,3-dihydroxy-cyclohex-2-ene-1-one; and (c) 1,3-diphenyl-2,3-dihydroxy-2-propene-1-one.

5. The thermally processable image-recording material as set forth in claim 1 wherein said material is image-able with light.

6. The thermally processable image-recording material as set forth in claim 1 wherein said material is image-able with heat.

7. The thermally processable image-recording material as set forth in claim 1 wherein said silver halide is the sole source of silver in said material.

8. The thermally processable image-recording material as set forth in claim 1 further including a silver salt.

9. The thermally processable image-recording material as set forth in claim 8 wherein said silver salt is silver behenate.

10. The thermally processable image-recording material as set forth in claim 8 wherein said Silver salt is silver benzotriazole.

11. The thermally processable image-recording material as set forth in claim 9 further including a thermal solvent.

12. The thermally processable image-recording material as set forth in claim 11 wherein said thermal solvent is a benzamide derivative.

13. The thermally processable image-recording material as set forth in claim 1 wherein said material comprises silver iodobromide, gelatin, and tetramethylreductic acid, and further includes succinaldehyde and 3,4-dimethylbenzamide.

* * * * *